US010376937B2

(12) United States Patent
Tsujimoto et al.

(10) Patent No.: US 10,376,937 B2
(45) Date of Patent: Aug. 13, 2019

(54) OUTER LAYER MATERIAL FOR COMPOSITE ROLL FOR ROLLING AND COMPOSITE ROLL FOR ROLLING

(71) Applicant: KUBOTA CORPORATION, Osaka (JP)

(72) Inventors: Yutaka Tsujimoto, Amagasaki (JP); Tsuyoshi Odan, Amagasaki (JP); Hiroyuki Kimura, Amagasaki (JP)

(73) Assignee: KUBOTA CORPORATION, Osaka (JP)

( * ) Notice: Subject to any disclaimer, the term of this patent is extended or adjusted under 35 U.S.C. 154(b) by 300 days.

(21) Appl. No.: 15/500,283

(22) PCT Filed: Aug. 6, 2015

(86) PCT No.: PCT/JP2015/072375
§ 371 (c)(1),
(2) Date: Jan. 30, 2017

(87) PCT Pub. No.: WO2016/031519
PCT Pub. Date: Mar. 3, 2016

(65) Prior Publication Data

US 2017/0225209 A1 Aug. 10, 2017

(30) Foreign Application Priority Data

Aug. 25, 2014 (JP) ..... 2014-170139

(51) Int. Cl.
*B21B 1/22* (2006.01)
*B21B 27/00* (2006.01)
(Continued)

(52) U.S. Cl.
CPC ..... *B21B 27/005* (2013.01); *B21B 1/22* (2013.01); *B21B 27/00* (2013.01); *B22D 13/00* (2013.01);
(Continued)

(58) Field of Classification Search
None
See application file for complete search history.

(56) References Cited

U.S. PATENT DOCUMENTS 5,225,007 A 7/1993 Hattori et al.
5,316,596 A * 5/1994 Kataoka ..... B21B 27/00 148/321

FOREIGN PATENT DOCUMENTS

CA 2 166 258 C 3/2002
CN 101386961 A 3/2009
(Continued)

OTHER PUBLICATIONS

State Intellectual Property Office of the People's Republic of China, "Office Action", from counterpart Chinese Patent Application No. 201580045767.9, dated Oct. 27, 2017, 6 pp. (No English language translation available).
(Continued)

*Primary Examiner* — Colin W. Slifka
(74) *Attorney, Agent, or Firm* — Eckert Seamans Cherin & Mellott, LLC

(57) ABSTRACT

The present invention provides an outer layer material for a composite roll for rolling, in which the strength of secondary eutectic carbides can be increased by reducing a B amount in the secondary eutectic carbides and surface roughening resistance can be improved, and a composite roll for rolling in which this outer layer material is used in an outer layer. The outer layer material for a composite roll for rolling of the present invention is an outer layer material for a composite roll for rolling containing C in an amount of 1.8 mass % or more and 2.5 mass % or less, Si in an amount of more than 0 mass % and 1.0 mass % or less, Mn in an amount of more than 0 mass % and 1.0 mass % or less, Ni in an amount of more than 0 mass % and 0.5 mass % or less, Cr in an amount of more than 3.0 mass % and 8.0 mass % or less, Mo
(Continued)

in an amount of more than 2.0 mass % and 10.0 mass % or less, W in an amount of more than 0 mass % and 10.0 mass % or less, V in an amount of more than 0 mass % and 10.0 mass % or less, and B in an amount of more than 0 mass % and less than 0.01 mass %, and a remaining portion including Fe and inevitable impurities.

8 Claims, 2 Drawing Sheets

(51) Int. Cl.

| | |
|---|---|
| ***B22D 13/02*** | (2006.01) |
| ***C21D 1/18*** | (2006.01) |
| ***C21D 1/613*** | (2006.01) |
| ***C21D 1/62*** | (2006.01) |
| ***C21D 9/38*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/56*** | (2006.01) |
| ***H05B 6/24*** | (2006.01) |
| ***B22D 13/00*** | (2006.01) |
| ***C22C 37/06*** | (2006.01) |
| ***C22C 37/08*** | (2006.01) |
| ***C22C 37/10*** | (2006.01) |
| ***C22C 38/52*** | (2006.01) |

(52) U.S. Cl.

CPC ..... *B22D 13/02* (2013.01); *C21D 1/18* (2013.01); *C21D 1/613* (2013.01); *C21D 1/62* (2013.01); *C21D 9/38* (2013.01); *C22C 37/06* (2013.01); *C22C 37/08* (2013.01); *C22C 37/10* (2013.01); *C22C 38/02* (2013.01); *C22C 38/04* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/56* (2013.01); *H05B 6/24* (2013.01); *B21B 2001/225* (2013.01)

(56) References Cited

FOREIGN PATENT DOCUMENTS

| | | | | |
|---|---|---|---|---|
| JP | 63-224859 | | † | 9/1988 |
| JP | HEI 03-254304 | A | | 11/1991 |
| JP | H05 98392 | A | | 4/1993 |
| JP | HEI 05-320819 | A | | 12/1993 |
| JP | H06 17185 | A | | 1/1994 |
| JP | H06 122937 | A | | 5/1994 |
| JP | H06 346187 | A | | 12/1994 |
| JP | 7-75808 | A | † | 3/1995 |
| JP | HEI 07-068304 | A | | 3/1995 |
| JP | HEI 07-075808 | A | | 3/1995 |
| JP | HEI 07-78267 | B2 | | 8/1995 |
| JP | 2001 234273 | A | | 8/2001 |
| JP | 2005-270991 | A | † | 10/2005 |
| JP | 2009-221573 | A | † | 10/2009 |
| JP | 2011 063822 | A | | 3/2011 |
| JP | 2012 117083 | A | | 6/2012 |
| KR | 100 611 201 | B1 | | 8/2006 |
| WO | 00/10743 | A1 | | 3/2000 |

OTHER PUBLICATIONS

European Patent Office, "extended European Search Report", from counterpart EP Application No. 15 83 6002.5, 12 pp., dated Mar. 2, 2018.

Japanese Patent Office, "Office Action" for corresponding JP Patent Application No. 2014-170139, dated Jul. 28, 2016, 2 pp. (English language translation not available).

Neutralization or Elimination Treatment of Boron from Molten Cast Iron; Toshitake Kannoand Ilgoo Kang, J.JFS, vol. 79, No. 8 (2007) pp. 459-464 (5 pages).†

Investigation of Advanced Utilization of Iron Scrap for FY2013, Mar. 2014, Tokyo Steel Co.,Ltd.(7 pages).†

What a roll for steel is; from Website of Yodogawa Steel Works, Ltd.,http://www.yodoko.co.jp/product/roll/steel.html, copyright 2009 (retrieved by May 22, 2018; 6 pages).†

* cited by examiner
† cited by third party

OUTER LAYER MATERIAL FOR COMPOSITE ROLL FOR ROLLING AND COMPOSITE ROLL FOR ROLLING

TECHNICAL FIELD

The present invention relates to an outer layer material for a composite roll for rolling that is used in hot rolling and a composite roll for rolling in which this outer layer material is used in an outer layer.

BACKGROUND ART

A composite roll for rolling that is used in hot rolling needs to have excellent wear resistance, surface roughening resistance, and crack resistance in its outer layer, which comes into contact with a steel sheet. Thus, a high-speed steel cast iron material is used in the outer layer material constituting the outer layer of the roll (for example, see Patent Document 1).

In recent years, from the viewpoint of increasing the productivity, a rolling pitch has decreased, and a heat load on an outer layer surface of a roll has increased. Also, steel sheets that are to be rolled have become thinner and harder, and thus wearing of the outer layer of the roll has increased.

Because the surface of the roll is repeatedly exposed to a high temperature of about 1000° C. and water cooling at about 30° C. during rolling, surface heat cracking occurs due to thermal shock, and structure loss in the micro scale occurs. When the degree of heat cracking and structure loss is low, it is said that the outer layer has good surface roughening resistance. Heat cracking and structure loss tend to occur with priority in eutectic carbides at grain boundaries that serve as final solidification regions.

The outer layer is exposed to heat resulting from molten metal in an intermediate layer or an inner core and heating resulting from high-temperature heat treatment such as austenitization after solidification. It was found that at the time of this heating, if the temperature was increased to a temperature exceeding a melting temperature of the eutectic carbides at the grain boundaries in the outer layer material, the eutectic carbides partially eroded, and cavities were formed. The surface roughening resistance of the outer layer decreases due to the formation of cavities, and the surface of the roll is deeply impaired, as a result of which the life of the roll shortens in some cases.

CITATION LIST

Patent Document

[Patent Document 1] JP H05-320819A

SUMMARY OF INVENTION

Technical Problem

In the outer layer made of a high-speed steel cast iron material, Cr, Mo, W, V, Nb, Fe, and the like bind to C so as to mainly form MC carbides. These carbides increase the hardness at room temperature and high temperatures and contribute to the improvement in wear resistance. Upon receiving thermal shock during rolling, the surface of the outer layer fissures, and the inventors of the present invention revealed that compared to the MC carbides, secondary eutectic carbides at grain boundaries that are susceptible to thermal shock partially eroded.

Moreover, the inventors found that the cause of partial erosion of the secondary eutectic carbides was B in the secondary eutectic carbides. That is, the inventors found that if molten metal having a high B concentration was cast, B was concentrated and mixed into the secondary eutectic carbides, the melting point of the secondary eutectic carbides decreased, and partial erosion easily occurred.

However, B is a component that has a functional effect of cleaning molten metal during casting and is effective in improving the quenching property, and good hardening is possible due to the secondary eutectic carbides containing B in a small amount.

An object of the present invention is to provide an outer layer material for a composite roll for rolling with which it is possible to increase the strength and a melting point of the secondary eutectic carbides due to the secondary eutectic carbides containing B in a small amount and improve surface roughening resistance, and a composite roll for rolling in which this outer layer material is used in an outer layer.

Solution to Problem

An outer layer material for a composite roll for rolling of the present invention is an outer layer material for a composite roll for rolling, containing:

C in an amount of 1.8 mass % or more and 2.5 mass % or less, Si in an amount of more than 0 mass % and 1.0 mass % or less, Mn in an amount of more than 0 mass % and 1.0 mass % or less, Ni in an amount of more than 0 mass % and 0.5 mass % or less, Cr in an amount of more than 3.0 mass % and 8.0 mass % or less, Mo in an amount of more than 2.0 mass % and 10.0 mass % or less, W in an amount of more than 0 mass % and 10.0 mass % or less, V in an amount of more than 0 mass % and 10.0 mass % or less, and B in an amount of more than 0 mass % and less than 0.01 mass %, and a remaining portion including Fe and inevitable impurities.

It is desirable that the outer layer material further contains Nb in an amount of 0.01 mass % or more and 2.0 mass % or less, and/or Ti in an amount of 0.01 mass % or more and 1.0 mass % or less.

It is desirable that a solidification speed in casting of the outer layer material is 8 mm/min or more.

It is desirable that the outer layer material contains a secondary eutectic carbide, and that a melting temperature of the secondary eutectic carbide is higher than 1100° C. Also, when a mass % of a B in a surface of the outer layer material is B(t1) and a mass % of the B in an inner surface of the outer layer material is B(t2), it is desirable that $B(t2)-B(t1)\geq 0.002$ is satisfied.

Also, in a composite roll for rolling of the present invention, the outer layer material is used in an outer layer, and an inner core, or an intermediate layer and an inner core are comprised on an inner side of the outer layer material.

Advantageous Effects of Invention

In the outer layer material for the composite roll for rolling of the present invention, the amount of B included in the secondary eutectic carbides can be reduced by adjusting the amount of B as described above. Doing so makes it possible to achieve an improvement in the strength of the secondary eutectic carbides, and thus even if the outer layer is exposed to a high temperature at about 1100° C. after solidification, it is possible to prevent erosion of the secondary eutectic carbides. The outer layer of the high-speed roll having secondary eutectic carbides that have no eroded portions can exhibit excellent surface roughening resistance.

The composite roll for rolling in which the outer layer material of the present invention is used in the outer layer include secondary eutectic carbides with a high strength and has excellent surface roughening resistance. Therefore, it is possible to reduce structure loss in the surface of the outer layer during rolling, reduce the frequency of grinding of the surface of the outer layer, and reduce depletion of the outer layer accompanying this.

Reason for Limiting Components

The outer layer material that constitutes the outer layer of the composite roll for rolling of the present invention is a high-speed steel cast iron material, and contains the following components. Note that hereinafter, unless otherwise specified, "%" indicates mass %.

C: 1.8 Mass % or More and 2.5 Mass % or Less

C mainly binds to Fe and Cr to form $M_7C_3$ high-hardness composite carbides, and binds to Mo, V, Nb, W, and the like to also form MC, $M_6C$, and $M_2C$ high-hardness composite carbides, for example. In order to form these high-hardness composite carbides, the mass % of C needs to be 1.8 mass % or more, and more preferably 1.85 mass % or more. On the other hand, if the outer layer material contains C in an amount of more than 2.5 mass %, the amount of carbides increases and the outer layer material becomes fragile, and crack resistance deteriorates. Therefore, the mass % of C is defined as being 2.5 mass % or less, and more preferably 2.25 mass % or less.

Si: More than 0 Mass % and 1.0 Mass % or Less

Si is added because Si is an element necessary for ensuring fluidity and deoxidation. On the other hand, if the amount of Si exceeds 1.0 mass %, the quenching property decreases and the material becomes fragile, and thus the Si content is more than 0 mass % and 1.0 mass % or less.

Mn: More than 0 Mass % and 1.0 Mass % or Less

Mn increases the hardenability. Also, Mn is an element that binds to S so as to produce MnS, and is effective in preventing embrittlement caused by S. On the other hand, an excessive increase in the Mn content causes a decrease in toughness, and thus the Mn content is defined as being more than 0 mass % and 1.0 mass % or less.

Ni: More than 0 Mass % and 0.5 Mass % or Less

Ni reduces the hardness at high temperatures, and thus addition of a small amount thereof is desired. However, when a large composite roll for rolling is produced, if a sufficient quenching speed is not obtained at the time of heat treatment, or if the quenching property of a low C and high V-based material deteriorates as with the present invention, Ni is added for the purpose of improving the quenching property. A lower limit of the Ni content is desirably 0.01 mass %. On the other hand, if the Ni content exceeds 0.5 mass %, the hardness at high temperatures significantly decreases, and thus an upper limit thereof is 0.5 mass %, and desirably 0.3 mass %.

Cr: 3.0 Mass % or More and 8.0 Mass % or Less

Cr is dissolved in a base to form a solid solution and improves the quenching property. Also, Cr forms eutectic carbides together with Mo and W. In order to improve the quenching property, the outer layer material needs to contain Cr in an amount of 3.0 mass % or more, and if the Cr content exceeds 8.0 mass %, the amount of eutectic carbides increases, and the tensile strength of the material decreases. Therefore, the Cr content is defined as being 3.0 mass % and 8.0 mass %. Desirably, Cr is set to 3.5 mass % or more and 6.5 mass % or less.

Mo: 2.0 Mass % or More and 10.0 Mass % or Less

Mo binds to C together with Fe, Cr, Nb, and W so as to mainly form $M_7C$, $M_6C$, and $M_2C$ composite carbides, increases the hardness at room temperature and high temperatures and contributes to the improvement in the wear resistance. Thus, the outer layer material contains Mo in an amount of at least 2.0 mass % or more, and desirably 4.0 mass % or more. On the other hand, if the outer layer material excessively contains Mo, remaining austenite is stabilized and high hardness is not likely to be obtained, and thus an upper limit thereof is defined as being 10.0 mass %, and desirably 7.0 mass %.

W: More than 0 Mass % and 10.0 Mass % or Less

Similarly, W is also included because it binds to C together with Fe, Cr, Mo, and Nb so as to form composite carbides, increases the hardness at room temperature and high temperatures and contributes to the improvement in the wear resistance. On the other hand, if the outer layer material contains W in an excessive amount, the toughness decreases, and heat crack resistance deteriorates. Thus, the upper limit is defined as being 10.0 mass %. Desirably, the upper limit of W is set to 2.0 mass %.

V: More than 0 Mass % and 10.0 Mass % or Less

V binds to C together with Fe, Cr, Mo, and W, mainly constitutes MC carbides at the time of solidification, increases the hardness at room temperature and high temperatures and contributes to the improvement in the wear resistance.

The MC carbides containing V increase the hardness at room temperature and high temperatures and contribute to the improvement in the wear resistance. These MC carbides are produced in the form of branches in the thickness direction, suppress plastic deformation of the base, thus contributing to improving mechanical properties and crack resistance. On the other hand, if the outer layer material contains V excessively, the carbides easily undergo segregation. Thus, the upper limit of V is defined as being 10.0 mass %, and desirably 8.0 mass %.

B: More than 0 Mass % and 0.01 Mass % or Less

The outer layer material contains B because B that has dissolved into the base has an effect of increasing the quenching property. The lower limit of the B content is preferably set to 0.0002 mass %. In the case of using a casting having a large mass, such as a composite roll for rolling, it is generally difficult to increase a cooling speed, but a good quenched structure is easily obtained due to an improvement in the quenching property. On the other hand, it is not preferable that the outer layer material excessively contains B because the melting point of the secondary eutectic carbides will decrease and the material will become fragile, and thus the upper limit of the B content in the cast iron material is set to 0.01 mass %.

Note that compared to the primary carbides such as minute MC carbides that crystallize during casting of the outer layer material, B is concentrated in coarse secondary eutectic carbides that undergo final solidification in a larger amount than in the base, and the B concentration in the secondary eutectic carbides further increases accompanying an increase in the B amount in the base. If the B concentration in the secondary eutectic carbides increases, the secondary eutectic carbides become coarse, and the melting point thereof decreases. If the melting point of the secondary eutectic carbides decreases in this manner, the secondary eutectic carbides melt due to heat caused by molten metal of an intermediate layer or an inner core after solidification of the outer layer, or at the time of high temperature heat treatment such as austenitization, and cavity-like erosion occurs. Moreover, the secondary eutectic carbides at grain boundaries are more fragile than at the other portions, and thus surface roughness caused by rolling occurs with priority in these secondary eutectic carbides, and the erosion further promotes this trend. However, this problem can be solved by adjusting the B amount in the outer layer. Furthermore, setting the solidification speed of the outer layer material to 10 mm/min or more makes it possible to keep B in the base, and to reduce the B amount in the secondary eutectic carbides, thus suppressing the occurrence of erosion. The surface roughening resistance of the outer layer can be improved by enabling suppression of the occurrence of erosion. Also, a homogeneous material can be obtained in high-temperature heat treatment of the outer layer by providing a difference in concentration between a B concentration in the inner surface of the outer layer material and a B concentration in the surface (outer surface) of the outer layer material. The difference in B concentration can be adjusted by dividing the addition of B into molten metal, for example. Specifically, when a mass % of the B in the surface of the outer layer material is B(t1) and a mass % of the B in the inner surface of the outer layer material is B(t2), it is preferable that the value of B(t2)−B(t1) is 0.002 or more. More preferably, it is 0.003 or more.

Note that if the value of B(t2)−B(t1) is excessively large, the B concentration in the inner surface of the outer layer material excessively increases, and thus it is preferably 0.008 or less, and more preferably 0.005 or less.

The above-described outer layer may further contain the following components.

Nb: 0.01 Mass % or More and 2.0 Mass % or Less, and/or
Ti: 0.01 Mass % or More and 1.0 Mass % or Less Nb binds to C together with Fe, Cr, Mo, and W so as to mainly form MC carbides, increases the hardness at room temperature and high temperatures and contributes to the improvement in the wear resistance. Also, Nb finely disperses MC carbides, has an effect of reducing the size of the structure, and contributes to an improvement in mechanical properties and crack resistance. Thus, the outer layer contains Nb in an amount of 0.01 mass % or more, and desirably in an amount of 0.1 mass % or more. On the other hand, if the outer layer contains Nb excessively, carbides easily undergo segregation. Thus, the upper limit of Nb is defined as being 1.0 mass %, and desirably 0.5 mass %.

Also, Ti produces oxides in molten metal, reduces the oxygen content in the molten metal, improves soundness of a product, and has an effect of reducing the size of the solidified structure since the produced oxides function as crystal nuclei. On the other hand, if the outer layer excessively contains Ti, there is a disadvantage in that Ti remains as debris. Thus, if Ti is added, the Ti content is set to 0.01 mass % or more and 1.0 mass % or less.

The outer layer material of the present invention contains the above-described components, and the remaining portion includes Fe and impurities that are inevitably mixed into the outer layer material.

Also, sometimes, the remaining portion contains P and S, and in this case, it is preferable to define the components as follows. If the P content exceeds 0.08 mass % and the S content exceeds 0.06 mass %, oxidation resistance and toughness decrease, and thus it is preferable that the P content is 0.08 mass % or less, and the S content is 0.06 mass % or less. Desirably, the upper limits of P and S are 0.05 mass % or less. On the other hand, because P improves machinability, the outer layer material preferably contains P in an amount of more than 0 mass %, and desirably in an amount of 0.015 mass % or more. Also, because S combines with Mn and improves machinability, the outer layer material preferably contains S in an amount of more than 0 mass %, and desirably in an amount of 0.005 mass % or more.

DESCRIPTION OF EMBODIMENTS

Figure 1:
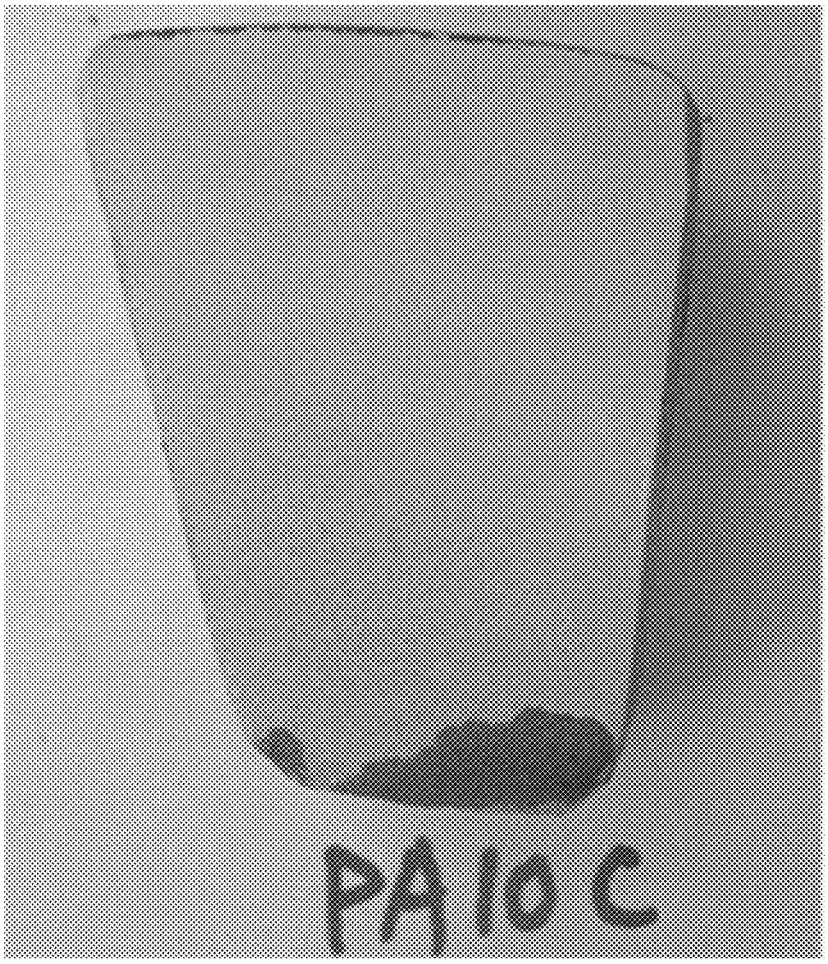
FIG. 1 is a photograph obtained by performing dye penetrant inspection on a test piece of Working Example 3, which is an invention example.

A composite roll for rolling of the present invention comprises an outer layer that is used for rolling, an intermediate layer and/or an inner core that are located on the inner side of the outer layer, and a shaft member. Examples of an inner core material for constituting the inner core include high strength materials such as high grade cast iron, ductile cast iron, and graphitic steel, and an example of the intermediate layer material for constituting the intermediate layer is an adamite material.

The outer layer can be cast by producing a molten alloy of the outer layer material containing the above-described components, and performing centrifugal casting or static casting, for example. Centrifugal casting may be vertical-type (rotation axis is oriented in a vertical direction), inclined-type (rotation axis is oriented in an oblique direction), or horizontal-type (rotation axis is oriented in a horizontal direction).

When the outer layer material is cast, the solidification speed is set to 8 mm/min or more. Adjustment of the solidification speed can be carried out by air-cooling or water-cooling a mold.

Defining the solidification speed of the outer layer material in this manner makes it possible to increase the B amount included in the base, and to inhibit B from being mixed into the secondary eutectic carbides.

A composite roll for rolling is produced by casting an inner core, or an intermediate layer and an inner core into the cast outer layer material, or shrink-fitting, or the like.

Desirably, quenching treatment is performed on the composite roll for rolling. B can improve the quenching property, and B is not concentrated in the secondary eutectic carbides in the present invention and therefore is included in the base in a large amount, and thus the hardness of the base can be further increased by quenching.

In the outer layer according to the present invention, a Vickers hardness of the secondary eutectic carbides may be, for example, 1500 HV to 1900 HV due to the above-described components and solidification speed. It is thought that the reason why the hardness increases in this manner is that the B amount in the secondary eutectic carbides decreases.

Moreover, even if the composite roll for rolling in which the above-described outer layer material is used in the outer layer receives a thermal shock in heat treatment or rolling, suppression of coarsening of the secondary eutectic carbides and an increase in the strength and the melting point make it possible to prevent the secondary eutectic carbides from falling off or eroding.

has excellent surface roughening resistance. Therefore, it is possible to suppress loss of the surface of the outer layer during rolling, and to reduce the frequency of grinding of the surface of the outer layer and reduce depletion of the outer layer accompanying this.

In particular, the composite roll for rolling in which the outer layer material of the present invention is used in the outer layer is suitable for application to front and sublevel stands in hot finishing rolling in which operational stability is required.

Working Examples

A molten alloy containing various components shown in Table 1 was produced and centrifugal casting was performed in a high-frequency induction furnace. The solidification speed of the outer layer material at the time of casting was adjusted to 8 mm/min or more. In Table 1, Working Examples 1 to 5 are invention examples. Note that Comparative Example 1 and Comparative Example 2 are outer layer materials containing B in an amount of more than 0.01%.

TABLE 1

| | C | Si | Mn | Ni | Cr | Mo | W | V | Nb | Ti | B |
|---|---|---|---|---|---|---|---|---|---|---|---|
| Work. Ex. 1 | 2 | 0.37 | 0.42 | 0.46 | 5.23 | 6.3 | 1.63 | 7.34 | | | 0.005 |
| Work. Ex. 2 | 2.09 | 0.63 | 0.49 | 0.11 | 3.93 | 4.19 | 0.45 | 6.05 | 0.58 | | 0.009 |
| Work. Ex. 3 | 2.4 | 0.59 | 0.54 | 0.02 | 5.38 | 4.51 | 0.43 | 5.74 | 0.25 | 0.075 | 0.003 |
| Work. Ex. 4 | 2.3 | 0.66 | 0.35 | 0.36 | 5.4 | 5.86 | 0.46 | 6.37 | 0.15 | 0.041 | 0.0002 |
| Work. Ex. 5 | 1.89 | 0.61 | 0.5 | 0.09 | 5.38 | 6.21 | 1.7 | 7.27 | | 0.05 | 0.0008 |
| Comp. Ex. 1 | 2.25 | 0.6 | 0.45 | 0.15 | 5.53 | 3.98 | 0.31 | 6.43 | 0.2 | 0.026 | 0.034 |
| Comp. Ex. 2 | 2.09 | 0.57 | 0.51 | 0.22 | 3.3 | 4.2 | 0.45 | 5.97 | 0.53 | 0.05 | 0.056 |

Note
that the unit is mass %

When the surface of the produced outer layer was observed, an area percentage of MC carbides was 7% to 15%, an area percentage of secondary eutectic carbides was 1% to 6%, and the remaining portion was the base. Adjustment of the B content and the solidification speed made it possible to suppress the growth of the secondary eutectic carbides. This means that the area percentage of the secondary eutectic carbides was reduced. Also, when the B amount in the outer layer was measured, the B amount in the surface of the outer layer was 0.006%, and the B amount in the inner surface of the outer layer was 0.009%, and when the mass % of the B in the surface of the outer layer material was B(t1) and the mass % of the B in the inner surface of the outer layer material was B(t2), the value B(t2)−B(t1) was 0.002 or more.

The composite roll for rolling in which the outer layer material of the present invention is used in the outer layer include secondary eutectic carbides with a high strength and After the outer layer material was cast, the inner core was cast to produce a composite roll for rolling.

Quenching was performed on the obtained composite roll for rolling. Quenching was performed by performing forced-air cooling with large fans such that a cooling speed on the roll surface from an austenitization temperature to 700° C. was 900° C./h or more.

With regard to composite rolls for rolling of the working examples and comparative examples on which quenching was performed, machining was performed, a plurality of test pieces were then cut out such that one side of each test piece was 30 mm or more and a thickness of each test piece was about 10 mm, and as shown in Table 2, the test pieces were held at a temperature of 1050° C. to 1125° C. for 30 minutes, and dye penetrant inspection was carried out on the test pieces to observe the states of the surfaces. In Table 2, "−" indicates a test piece in which erosion was not confirmed in dye penetrant inspection, and "+" indicates a test piece in which erosion was confirmed.

TABLE 2

| | Work. Ex. 1 B: 0.005% | Work. Ex. 2 B: 0.009% | Work. Ex. 3 B: 0.003% | Work. Ex. 4 B: 0.0002% | Work. Ex. 5 B: 0.0008% | Comp. Ex. 1 B: 0.034% | Comp. Ex. 2 B: 0.056% |
|---|---|---|---|---|---|---|---|
| 1050° C., 30 min | – | – | – | – | – | – | – |
| 1075° C., 30 min | – | – | – | – | – | + | + |
| 1100° C., 30 min | – | – | – | – | – | + | + |
| 1125° C., 30 min | – | – | – | – | – | + | + |

With reference to Table 2, it is found that in all of Working Example 1 to Working Example 5, which are the invention examples, erosion of the secondary eutectic carbides did not occur even in the case where the test pieces were held at 1050° C. to 1125° C. for 30 minutes. FIG. 1 is a photograph of the test piece of Invention Example 3. With reference to FIG. 1, no indicating mark was observed on the surface of the test piece.

This means that in the test pieces of the working examples, by setting the solidification speed to 8 mm/min, a large amount of B remained in the base and it was possible to inhibit B from being mixed into the secondary eutectic carbides. That is, it is found that preventing concentrated B from being mixed into the secondary eutectic carbides makes it possible to improve the hardness of the secondary eutectic carbides, and to prevent the secondary eutectic carbides from eroding even if the test pieces were held at high temperatures.

Figure 2:
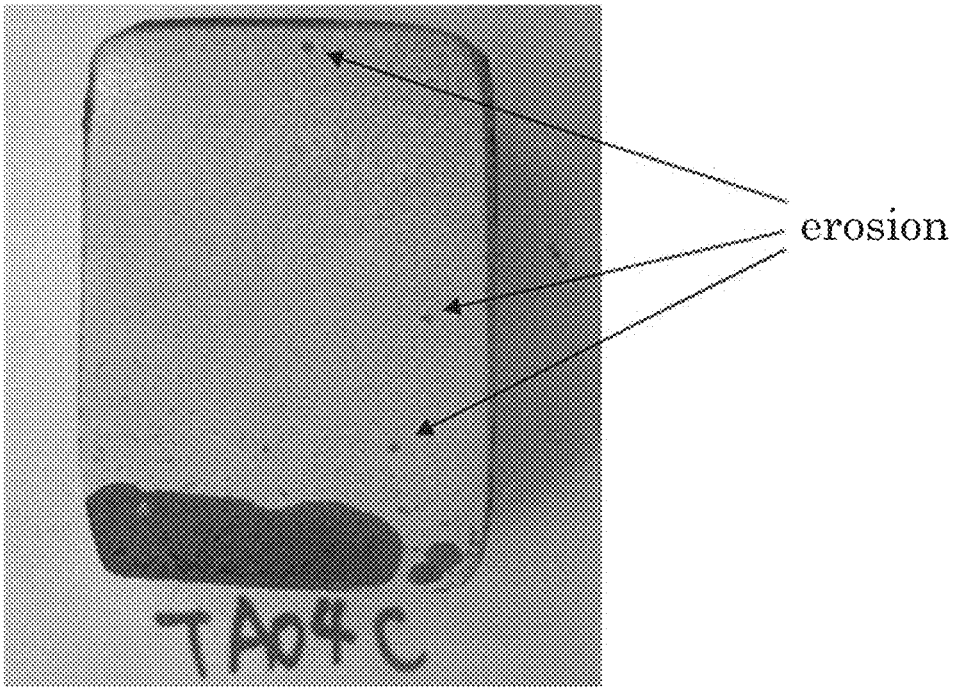
FIG. 2 is a photograph obtained by performing dye penetrant inspection on a test piece of Comparative Example 2.
Figure 3:
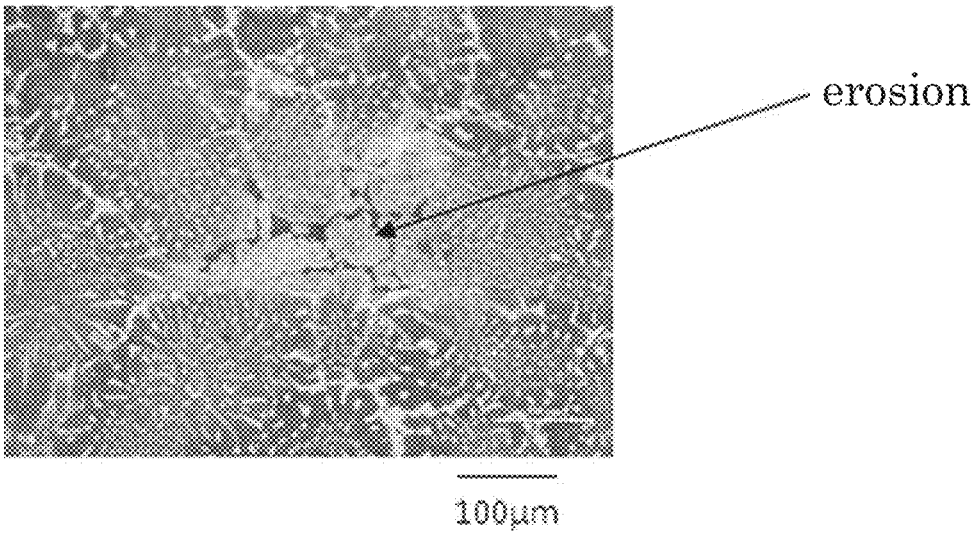
FIG. 3 is a photograph showing an enlarged eroded region in FIG. 2.

On the other hand, it is found that in the comparative examples, erosion of the secondary eutectic carbides was not confirmed at 1050° C., but erosion was confirmed at 1100° C. or more. FIG. 2 is a photograph of the test piece of Comparative Example 2. With reference to FIG. 2, indicating marks caused by melted secondary eutectic carbides were observed at a plurality of locations on the surface of the test piece. FIG. 3 is an enlarge photograph of the indicating marks in FIG. 2. As shown in FIG. 3, it is found from the indicating marks that structure loss occurred. This means that as a result of B being concentrated and mixed into the secondary eutectic carbides, the secondary eutectic carbides melted at a high temperature.

Note that with regard to the working examples, if the test pieces were held in the condition of 1150° C. for 30 minutes, erosion of the secondary eutectic carbides was confirmed.

The description is for describing the present invention, and should not be interpreted as limiting or restricting the scope of claims of the present invention. Furthermore, it goes without saying that the configurations of the constituent elements of the present invention are not limited to those in the working examples, and that various modifications are possible within the technical scope of the claims

INDUSTRIAL APPLICABILITY

The present invention is useful for an outer layer material for a composite roll for rolling that is used in hot rolling and a composite roll for rolling in which this outer layer material is used in an outer layer.

The invention claimed is:

1. An outer layer material for a composite roll for rolling, comprising:

C in an amount of 1.8 mass % or more and 2.5 mass % or less, Si in an amount of more than 0 mass % and 1.0 mass % or less, Mn in an amount of more than 0 mass % and 1.0 mass % or less, Ni in an amount of more than 0 mass % and 0.5 mass % or less, Cr in an amount of more than 3.0 mass % and 8.0 mass % or less, Mo in an amount of 4.0 mass % or more and 10.0 mass % or less, W in an amount of more than 0 mass % and 2.0 mass % or less, V in an amount of more than 0 mass % and 10.0 mass % or less, and B in an amount of more than 0 mass % and less than 0.01 mass %, and a remaining portion including Fe and inevitable impurities;

the outer layer comprising an outer part wherein a mass % of B is B(t1) and an inner part wherein a mass % of B is B(t2), and $B(t2)-B(t1) \geq 0.002$.

2. The outer layer material for a composite roll for rolling according to claim 1, wherein Mo in an amount of 4.19 mass % or more and 6.3 mass % or less, Win an amount of 0.43 mass % or more and 1.7 mass % or less.

3. The outer layer material for a composite roll for rolling according to claim 2, further comprising Nb in an amount of 0.01 mass % or more and 2.0 mass % or less, and/or Ti in an amount of 0.01 mass % or more and 1.0 mass % or less.

4. The outer layer material for a composite roll for rolling according to claim 1, further comprising Nb in an amount of 0.01 mass % or more and 2.0 mass % or less, and/or Ti in an amount of 0.01 mass % or more and 1.0 mass % or less.

5. The outer layer material for a composite roll for rolling according to claim 1, wherein the outer layer material contains a secondary eutectic carbide, and a melting temperature of the secondary eutectic carbide is higher than 1100° C.

6. The outer layer material for a composite roll for rolling according to claim 1, wherein an area percentage of MC carbides of the surface of the outer layer material is 7% to 15%.

7. The outer layer material for a composite roll for rolling according to claim 1, wherein an area percentage of secondary eutectic carbides of the surface of the outer layer material is 1% to 6%.

8. A composite roll for rolling, wherein the outer layer material according to claim 1 is used in an outer layer, and an inner core, or an intermediate layer and an inner core are comprised on an inner side of the outer layer material.

* * * * *